US007131541B2

(12) United States Patent
Riner

(10) Patent No.: US 7,131,541 B2
(45) Date of Patent: Nov. 7, 2006

(54) ELECTRICAL SYSTEM ASSEMBLY WITH MOUNTING BRACKET

(75) Inventor: Raymond H. Riner, Hicksville, OH (US)

(73) Assignee: Pent Technologies, Inc., Kendallville, IN (US)

( * ) Notice: Subject to any disclaimer, the term of this patent is extended or adjusted under 35 U.S.C. 154(b) by 385 days.

(21) Appl. No.: 10/425,347

(22) Filed: Apr. 29, 2003

(65) Prior Publication Data

US 2003/0201238 A1 Oct. 30, 2003

Related U.S. Application Data

(60) Provisional application No. 60/376,782, filed on Apr. 30, 2002.

(51) Int. Cl.
*A47F 7/00* (2006.01)

(52) U.S. Cl. ..... 211/26

(58) Field of Classification Search ..... 211/26; 385/134, 135, 136, 137
See application file for complete search history.

(56) References Cited

U.S. PATENT DOCUMENTS 3,931,946 A 1/1976 Soltysik ..... 248/68
5,854,738 A 12/1998 Bowler ..... 361/695
6,036,517 A 3/2000 Byrne ..... 439/215
6,116,566 A 9/2000 Brown et al. ..... 248/694
6,149,115 A 11/2000 Gates et al. ..... 248/222.11
6,155,433 A * 12/2000 Anderson et al. ..... 211/26
6,201,698 B1 3/2001 Hunter ..... 361/704
6,236,573 B1 5/2001 Gundlach et al. ..... 361/801
6,269,001 B1 7/2001 Matteson et al. ..... 361/695
6,715,619 B1 * 4/2004 Kim et al. ..... 211/26

* cited by examiner

*Primary Examiner*—Sarah Purol
(74) *Attorney, Agent, or Firm*—Taylor & Aust, P.C.

(57) ABSTRACT

A bracket assembly for tool-less mounting in a raceway including a pair of substantially identical brackets, mated together, including a first bracket and a second bracket. Each bracket includes a support body, at least one lockable protrusion connected to the support body, at least one protrusion lock connected to the support body and at least one snap connecting mechanism connected to the support body, the at least one connecting mechanism for connecting with a structural member. The at least one lockable protrusion of the first bracket is engaged with at least one protrusion lock of the second bracket to thereby prevent relative movement of the first bracket with the second bracket.

7 Claims, 2 Drawing Sheets

ELECTRICAL SYSTEM ASSEMBLY WITH MOUNTING BRACKET

CROSS REFERENCE TO RELATED APPLICATIONS

This is a non-provisional application based upon U.S. provisional patent application Ser. No. 60/376,782, entitled "ELECTRICAL SYSTEM ASSEMBLY WITH MOUNTING BRACKET", filed Apr. 30, 2002.

BACKGROUND OF THE INVENTION

1. Field of the Invention

The present invention relates to mounting brackets for an electrical system assembly, and, more particularly, to an electrical system assembly with mounting brackets for tool-less installation in a raceway.

2. Description of the Related Art

The modern office environment often consists of a large open area of floor space that is divided into separate and distinct work areas by way of a modular wall panel system. Modular wall panels can be moved about with relative ease, to change an entire office floor plan. Contained in the modular wall panels are modular power distribution systems, which may include a wiring harness that is connected with a modular electrical device such as an electrical receptacle. The wiring harness typically includes a plurality of wires, which are associated with line, neutral and ground conductors of the power distribution system.

Associated with the modular power distribution system are mounting brackets that are connected to the modular wall panels by way of fasteners. A wiring harness is installed in a modular wall panel using tools to install the fasteners provided by the manufacturer. To electrically reconfigure the wiring harness of a modular wall panel system, tools are used to remove the fasteners holding the wiring harness in place.

What is needed in the art is a relatively easy way to connect a wiring harness to a modular wall panel.

SUMMARY OF THE INVENTION

The present invention provides an electrical system assembly with a mounting bracket that allows tool-less connection to a modular wall panel.

The invention comprises, in one form thereof, a bracket assembly for tool-less mounting in a raceway including a pair of substantially identical brackets, mated together, including a first bracket and a second bracket. Each bracket includes a support body, at least one lockable protrusion connected to the support body, at least one protrusion lock connected to the support body and at least one snap connecting mechanism connected to the support body, the at least one connecting mechanism for connecting with a structural member. The at least one lockable protrusion of the first bracket is engaged with at least one protrusion lock of the second bracket to thereby prevent relative movement of the first bracket with the second bracket.

An advantage of the present invention is that the mounting bracket allows easy installation and disassembly of a wiring harness from a modular wall panel.

Another advantage of the present invention is that the mounting bracket assembly snaps into place in a raceway of a modular wall panel.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
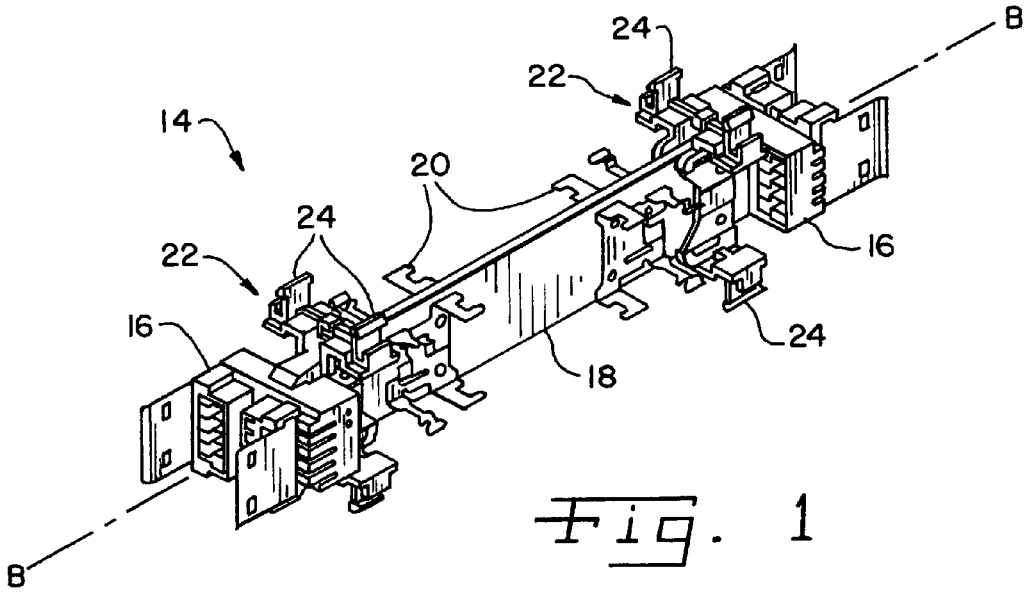
FIG. 1 is a perspective view of an electrical system assembly including an embodiment of a mounting bracket assembly of the present invention.
Figure 2:
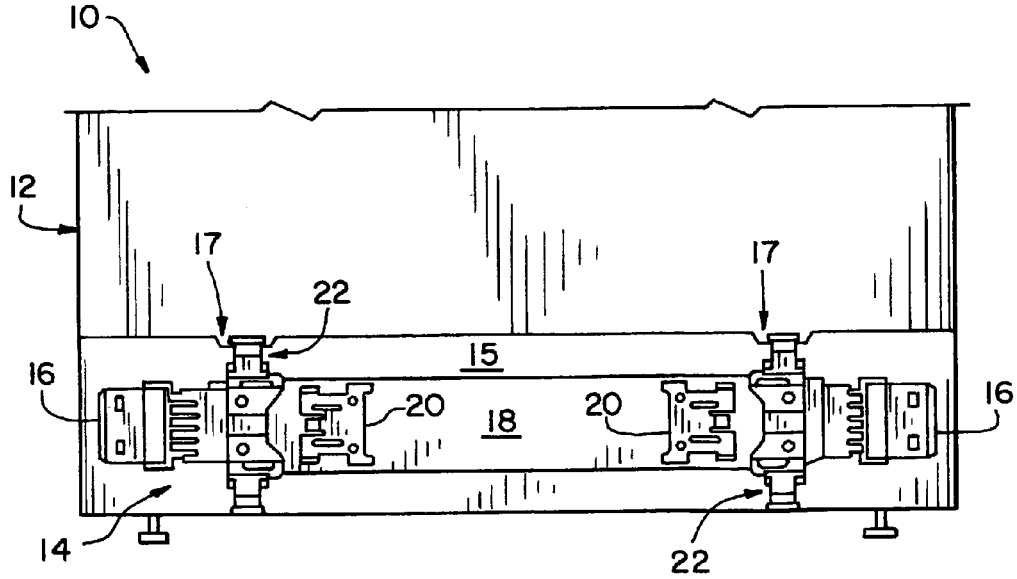
FIG. 2 is a front view of the electrical wiring assembly including the mounting bracket shown in FIG. 1.

Referring now to the drawings, and more particularly to FIGS. 1 and 2, there is shown a modular wall panel system 10 including wall panel 12 and electrical system assembly 14. Modular wall panel system 10 is a typical system used in an office environment that allows the construction of office modules within an open area of an office floor space. Wall panel 12 includes at least one electrical system assembly 14 and a raceway 15, in which electrical assembly 14 is removably attached to connecting features 17. Electrical system assembly 14 is normally disposed along a bottom edge of wall panel 12.

Electrical system assembly 14 includes interface connectors 16, wire channel 18, modular receptacle retaining brackets 20 and bracket assemblies 22. Interface connectors 16 electrically interconnect with conductors (not shown) within wire channel 18 thereby conducting electrical power from one end of electrical system assembly 14 to another end of electrical system assembly 14. Interface connectors 16 also electrically connect modular receptacles (not shown) along a face of each side of wire channel 18. Modular receptacle retaining brackets 20 are spaced to accommodate corresponding modular receptacles that are mounted along wire channel 18 and interconnected with interface connector 16.

Figure 3:
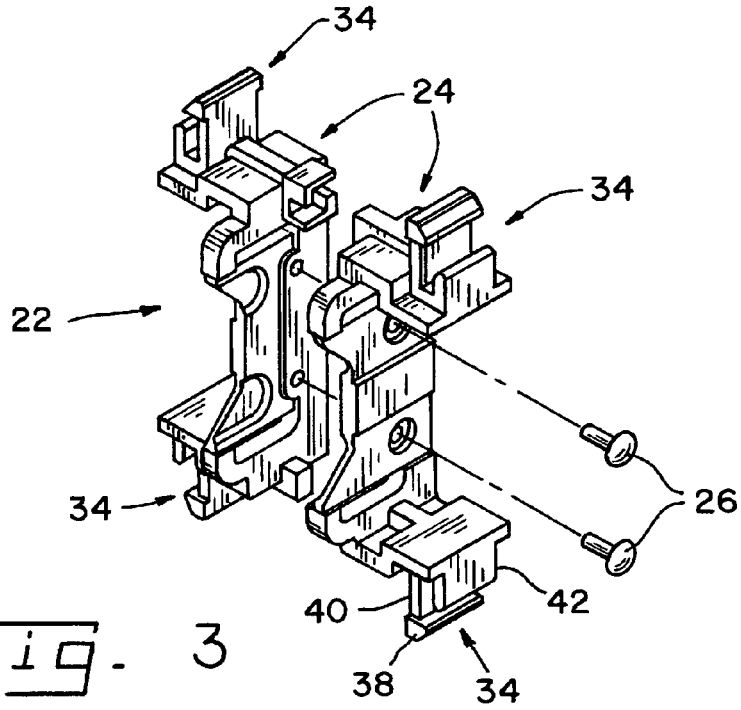
FIG. 3 is an exploded perspective view of the pair of mounting brackets shown in FIGS. 1 and 2.
Figure 4:
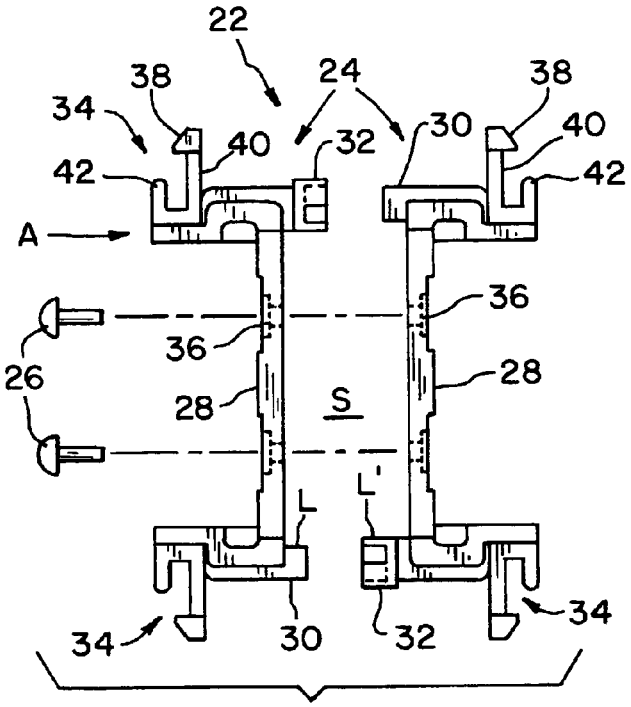
FIG. 4 is an exploded side view of the pair of mounting brackets shown in FIGS. 1–3.
Figure 5:
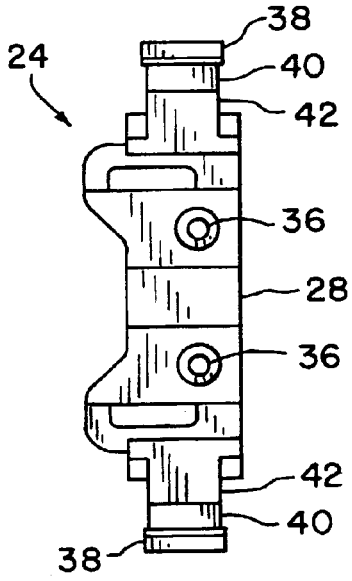
FIG. 5 is another side view of the mounting brackets shown in FIGS. 1–4.

Now, additionally referring to FIGS. 3–5, there is shown bracket assembly 22 including two brackets 24 and fasteners 26. Fasteners 26 extend through each bracket 24 with wire channel 18 spaced between two brackets 24. Each bracket 24 is identical and they are shown in FIGS. 3 and 4, as they are lockingly assembled together in a hermaphroditic manner. The two brackets 24, of each bracket assembly 22, are on opposite sides of longitudinal axis B. Where longitudinal axis B runs the length of electrical system assembly 14 and is centrally located therein.

Each bracket 24 includes support body 28, lockable protrusion 30, protrusion lock 32, connecting mechanism 34 and holes 36. Support body 28 is a thin support structure, which connects one end of bracket 24 to another. Support body 28 is thin enough that when brackets 24 are installed on wire channel 18 an electrical modular receptacle is able to connect with interface connector 16 without interference from bracket 24.

Lockable protrusion 30 of one bracket 24 interfaces with protrusion lock 32 of another bracket 24 when oriented as shown in FIG. 4. Lockable protrusion 30 engages protrusion lock 32 along an insertion axis A. Once lockable protrusion 30 has been inserted into protrusion lock 32, as long as they are not disengaged along axis A, the two brackets 24 remain engaged. Lockable protrusion 30 and protrusion lock 32 each have a length, protrusion lock 30 having length L and protrusion lock 32 having length L'. When lockable protrusion 30 has been inserted into protrusion lock 32 along axis A, length L and length L' serve to define a width dimension of a space S formed between brackets 24. Cross-sectional space S approximates the cross-sectional dimensions of wire channel 18. It is in space S that wire channel 18 is positioned.

Connecting mechanism 34 includes retaining feature 38, flexible arm 40 and release feature 42. Retaining feature 38 is attached to flexible arm 40 allowing retaining feature 38 to removably engage connecting features 17 that are in the form of a ledge, a lip or an opening 17 in a wall of raceway 15. Retaining feature 38 has a ramped surface, which co-acts with flexible arm 40 to allow the assembled brackets to be snapped into place. The face of retaining features 38 on each of the two brackets 24 are directed in opposite directions and face outwardly from longitudinal axis B. The disposition of connecting mechanism 34 on each of the pair of brackets, as shown in FIGS. 1, 3 and 4, are such that flexible arms 40, on the two brackets 24, deflect in opposite directions when pressed into position in raceway 15. To disengage retaining feature 38, flexible arm 40 may be depressed to allow the removal of bracket assembly 22 from wall panel 12. Alternatively, release feature 42 can be depressed causing retaining feature 38 to bend away from connecting feature 17 in raceway 15 thereby releasing bracket assembly 22 therefrom. Connecting mechanism 34 allows the tool-less insertion and attachment of bracket assembly 22 into wall panel 12.

Electrical system assembly 14, also known as wiring harness 14, is assembled by connecting wire channel 18 to interface connector 16, mounting modular receptacle retaining brackets 20 on wire channel 18 and mounting brackets 24 to wire channel 18 using fasteners 26. Fasteners 26 pass through one bracket 24, wiring channel 18 and another bracket 24 then are secured thereto. Although fasteners 26 may be of any form, they are shown, in FIGS. 3 and 4, in the form of rivets being inserted through brackets 24. Fasteners 26 retain each pair of brackets 24 on wiring channel 18. Two sets of bracket assemblies 22 are assembled on wire channel 18 to support each end of wire channel 18. Alternatively, more than two sets of bracket assemblies 22 may be used to support wire channel 18 along its length.

Wiring harness 14 is inserted into wall panel 12 without the use of tools. This tool-less insertion of wiring harness 14 into wall panel 12 is accomplished by pressing wiring harness 14 into a portion of wall panel 12, which allows retaining features 38 to removably engage opening 17 in raceway 15 of wall panel 12. The insertion of wiring harness 14 into raceway 15 is accomplished while keeping longitudinal axis B parallel with the walls of raceway 15 and simultaneously engaging openings 17.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical system assembly for use in office furniture, comprising:

at least one pair of substantially identical brackets, including a first bracket and a second bracket, each bracket including:

a support body;

at least one lockable protrusion connected to said support body;

at least one protrusion lock connected to said support body;

at least one connecting mechanism connected to said support body; and a wire channel connected to said at least one pair of brackets, said wire channel carrying at least one conductor therein, at least one said lockable protrusion of said first bracket is engaged with at least one said protrusion lock of said second bracket to thereby prevent relative movement of said first bracket with said second bracket, said first bracket and said second bracket being interconnected and surrounding a portion of said wire channel.

2. The assembly of claim 1, wherein each said lockable protrusion of said first bracket is removably engaged with a corresponding one of said at least one protrusion lock of said second bracket and each said lockable protrusion of said second bracket is removably engaged with a corresponding one of said at least one protrusion lock of said first bracket.

3. The assembly of claim 1, wherein said first bracket and said second bracket are on opposite sides of a longitudinal axis.

4. The assembly of claim 1, wherein at least one of said locking protrusion and said protrusion lock have a length, said length being such that a support space is defined between said support body of said first bracket and said support body of said second bracket.

5. The assembly of claim 4, wherein said wire channel traverses said support space.

6. The assembly of claim 1, wherein said at least one connecting mechanism, comprises:

a flexible arm connected to said support body; and a retaining feature disposed on an end of said flexible arm.

7. The assembly of claim 6, wherein said first bracket and said second bracket are on opposite sides of a longitudinal axis, said at least one connecting mechanism of said first bracket and said at least one connecting mechanism of said second bracket each facing outward from said longitudinal axis.

* * * * *